US006447092B1

(12) United States Patent
Norton

(10) Patent No.: US 6,447,092 B1
(45) Date of Patent: Sep. 10, 2002

(54) SIGNALING METHOD FOR A PEN DRIVER CIRCUIT INTERFACE

(75) Inventor: Kirkpatrick W Norton, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/940,267

(22) Filed: Aug. 27, 2001

Related U.S. Application Data

(63) Continuation of application No. 09/390,248, filed on Sep. 3, 1999, now Pat. No. 6,309,040.

(51) Int. Cl.[7] ..... B41J 29/38
(52) U.S. Cl. ..... 347/19; 347/11
(58) Field of Search ..... 347/5, 9, 11, 42, 347/60, 19

(56) References Cited

U.S. PATENT DOCUMENTS 5,189,442 A 2/1993 Herbert ..... 347/2
5,363,134 A 11/1994 Barbehenn et al. ..... 347/49
5,430,554 A 7/1995 Konakai ..... 358/409
5,477,246 A * 12/1995 Hirabayashi et al. ..... 347/12
5,596,423 A 1/1997 Pritchard ..... 358/433
5,778,253 A 7/1998 Blair et al. ..... 395/888
5,815,180 A 9/1998 Barbour et al. ..... 347/59
5,821,954 A 10/1998 Imai et al. ..... 347/35
5,838,888 A 11/1998 Oda ..... 395/115
5,896,146 A 4/1999 Murata et al. ..... 347/42
5,907,331 A * 5/1999 Markham ..... 347/12
5,914,731 A * 6/1999 Yano et al. ..... 347/9
6,145,948 A * 11/2000 Kishida ..... 347/13

* cited by examiner

*Primary Examiner*—Raquel Yvette Gordon
*Assistant Examiner*—Alfred E Dudding
(74) *Attorney, Agent, or Firm*—Jerry R. Potts

(57) ABSTRACT

A signaling method for a pen driver circuit interface is embodied in a signal interface between a controller circuit and a pen driver circuit for a printer. At least one signal of the interface is omitted; and the pen driver circuit is modified to process a combination of signals including at least one of the signals on the signal interface to provide information pertaining to the at least one omitted signal. According to a preferred method, the combination of signals are processed when data is not being transferred via the signal interface to provide a pen firing control signal for the printer such as a warm enable signal or a fire enable signal.

17 Claims, 3 Drawing Sheets

SIGNALING METHOD FOR A PEN DRIVER CIRCUIT INTERFACE

RELATED APPLICATIONS

This is a continuation of application Ser. No. 09/390,248 filed on Sep. 3, 1999, entitled "Signaling Method For A Pen Driver Circuit Interface," now U.S. Pat. No. 6,309,040 B1, issued on Oct. 30, 2001.

BACKGROUND OF THE INVENTIONS

1. Field of Inventions

The present invention relates generally to a signaling method for a pen driver circuit interface and, more specifically, to a signaling method employing a pen driver circuit to process a combination of signals including at least one signal from a signal interface in order to provide information associated with a signal line which has been eliminated from the signal interface.

2. Description of the Related Art

FIG. 1 shows a controller/driver/pen system 100 including a controller circuit 102, a pen driver circuit 104 and a pen 106 for a printer. The system 100 includes a conventional serial interface 108 between the controller circuit 102 and the pen driver circuit 104. The system 100 also includes a conventional signal interface 110 between the pen driver circuit 104 and the pen 106.

Generally, the digital pen controller 102 is responsible for communicating with the analog pen driver integrated circuit ("IC") 104 to control the InkJet pens. More specifically, the controller circuit 102 provides data and timing information to the pen driver circuit 104 to fire drops of ink. Also, the controller circuit 102 monitors the pen head temperature and pulse-warms the pen 106 if it is not warm enough to maintain acceptable print quality.

FIG. 2 shows a timing diagram 200 of the signals typically found in such systems, namely, CLOCK 202, DATA 204, LOAD 206, FIRESTROBE 208, and WARMSTROBE 210 (the names of the signals may vary, but the functions are usually the same). In this example of a typical signaling scheme, the CLOCK signal 202 is used to shift data bit-by-bit over the DATA signal 204 from the digital application-specific integrated circuit ("ASIC") 102 to the pen driver IC 104. A single bi-directional DATA signal 204 is shown because some status information could be returned from the pen driver IC 104 on the same line when data is not being transferred in. Some systems may have multiple DATA signals. Once all of the data bits have been shifted into an internal shift register of the pen driver IC 104, the rising edge, for example, of the LOAD signal 206 transfers the shift register contents into an internal control register of the pen driver IC 104. This loading step is necessary to prevent the pen driver IC 104 from responding to the shifting data as the bits trickle over each of the various control bit positions. Once the data has been transferred and loaded, firing and warming may begin.

For the sake of simplicity, the timing diagram 200 shows both the FIRESTROBE signal 208 and the WARMSTROBE signal 210 being asserted on the same transfer. This may or may not be the case. The FIRESTROBE signal 208 causes pen nozzle resistors in the pen 106 which have been selected by the transferred data to be driven with electrical current for a sufficiently long period of time to heat the resistor to a high enough temperature to fire a drop of ink. The WARMSTROBE signal 210 is used to drive current through all of the nozzle resistors, regardless of which nozzles have been selected for firing. The WARMSTROBE pulse 210 is generated for a sufficiently long period of time to heat the nozzle resistors (and therefore the pen head), but is short enough in duration to avoid firing ink out of the nozzles.

FIG. 9 is a schematic of an exemplary conventional multiplexing circuit 900 for controlling nozzles in a printhead of a printer which has sixteen (16) groups of nozzles, with four (4) nozzles in each group. The multiplexing circuit 900 includes nozzle group selection logic 902, AND-gates 904, 906, 908 and 910, OR-gates 912, 914, 916 and 918, and AND-gates 920, 922, 924 and 926 configured as shown.

In operation, only one nozzle group is selected at a time via the four group select bits provided as inputs to the group selection logic 902. By way of example, when group 'n' is selected, all four nozzles in group 'n' are driven whenever the "Warm Enable Pulse" 210 is asserted. If the "Warm Enable Pulse" 210 is not asserted, any of the nozzles in group 'n' will be driven whenever the "Fire Enable Pulse" 208 is asserted and the corresponding "Select Bits" for those nozzles are asserted. If neither the "Warm Enable Pulse" 210 or the "Fire Enable Pulse" 208 is asserted, no nozzles are driven. In logic terms, a nozzle is driven when: (its group is selected) AND ((the "Warm Enable Pulse" 210 is asserted) OR (the "Fire Enable Pulse" 208 is asserted AND the nozzle is selected)).

A drawback of the above-described signaling implementation is that five signals are required to perform all of the functions necessary to provide data shifting, data loading, and independent nozzle firing and pulse warming.

A possible solution would be to make the pen driver IC 104 more "intelligent" so that it can automatically warm and fire the pen 106 once data has been received from the digital controller 102. Such a system could theoretically have a pen driver IC 104 with only one control signal that uses a self-clocking serial data transfer protocol to receive data from the digital controller ASIC 102. Once all the data has arrived, the "smart" pen driver IC 104 would wait an appropriate amount of time per its programming before firing the pen 106, and would also monitor the pen head temperature to automatically warm the pen 106 without intervention from the digital ASIC 102. While such an approach would provides a single control signal, it requires a more complex pen driver IC 104. Pen driver ICs are power devices designed to drive high currents at high voltages; however, they are not well suited for containing control logic. Furthermore, such a "smart" pen driver 104 would require a phased-locked loop ("PLL") to synchronize with the data stream on the single control line since there is no dedicated clock.

Another possible solution would be to provide a two wire signal interface having just CLOCK and DATA signals. Although such a signal interface would not require a PLL, the pen driver circuit 104 would still need to automatically control the timing of the firing and warming events, which would require on-chip timers and an oscillating clock circuit on the IC 104 or on the printed circuit board ("PCB").

In summary, the addition of a PLL and/or timers to the pen driver circuit 104 increases the complexity and cost of the pen driver IC 104 by adding circuitry that analog fabrication processes are not well suited for. Additionally, placing control of the firing and warming timing in the pen driver IC 104 could reduce flexibility, possibly making the IC 104 less desirable to be used in future products. If the pen driver IC 104 is located on a carriage printed circuit assembly ("PCA"), an oscillating clock at the carriage would also have increased radiated emissions at radio frequencies, which may require extra cost to suppress in order to satisfy regulatory requirements.

Thus, a need exists for a control interface to an InkJet pen driver IC that provides lower system cost without sacrificing functionality, namely, a pen driver IC signaling implementation which provides the full functionality and information content of a conventional control interface and reduces the number of control signals, without adding a significant amount of circuitry to the pen driver circuit.

SUMMARY OF THE INVENTIONS

A signaling method for a pen driver circuit interface in accordance with one embodiment of the present invention reduces a number of signal lines in a signal interface between a controller circuit and a pen driver circuit of a printer by employing combinations of signals including at least one signal on the signal interface to provide information associated with a signal line which has been eliminated from the signal interface. The pen driver circuit is configured to process the combination of signals to provide the information which includes, for example, firing and warming pulse signal information for controlling nozzles in a printhead of the printer. In an exemplary preferred embodiment, combinations of the data transfer signals that do not conventionally occur while data is being transferred are processed by the pen driver circuit. In an exemplary preferred embodiment, the combination of signals includes a load signal extended beyond its conventional duration.

A method of signaling for a pen driver interface in accordance with another embodiment of the present invention includes the steps of: eliminating a pen firing control signal from an interface between a controller and a pen driver circuit; and employing the pen driver circuit to derive the pen firing control signal from a combination of signals remaining on the interface.

A method of signaling for a pen driver interface in accordance with another embodiment of the present invention includes the steps of: reducing a number of signal lines for a signal interface between a controller circuit and a pen driver circuit for a printer; and, when data is not being transferred via the signal interface, employing the pen driver circuit to process a combination of signals including at least one data transfer signal from the signal interface to provide information associated with a signal line which has been eliminated from the signal interface.

A method of signaling for a pen driver interface in accordance with another embodiment of the present invention includes the steps of: providing a signal interface between a controller circuit and a pen driver circuit for a printer; extending the duration of a data transfer signal of the signal interface; and configuring the pen driver circuit to process a combination of signals from the signal interface including the data transfer signal to provide a pen firing control signal.

A method of signaling for a pen driver interface in accordance with another embodiment of the present invention includes the steps of: providing a signal interface between a controller circuit and a pen driver circuit for a printer; and employing the pen driver circuit to derive a pen firing control signal for the printer from a combination of signals, the combination of signals including at least one data transfer signal provided to the pen driver circuit by the signal interface.

The above described and many other features and attendant advantages of the present inventions will become apparent as the inventions become better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention.

Figure 1:
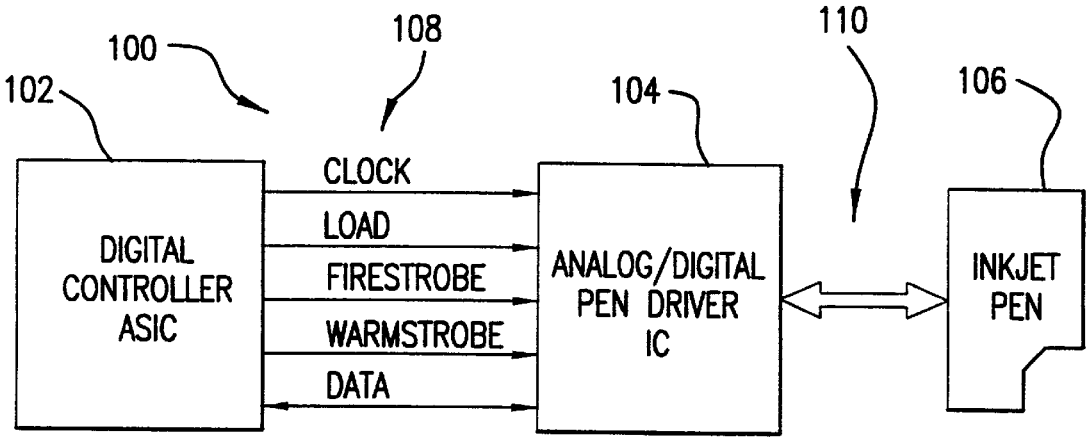
FIG. 1 is a functional block diagram of a controller circuit and a pen driver circuit for a printer and a conventional serial interface therebetween; according to an exemplary preferred embodiment of the present invention, at least one signal of the interface is omitted and the pen driver circuit is configured to process a combination of signals including at least one of the signals remaining on the interface to provide the at least one omitted signal.
Figure 3:
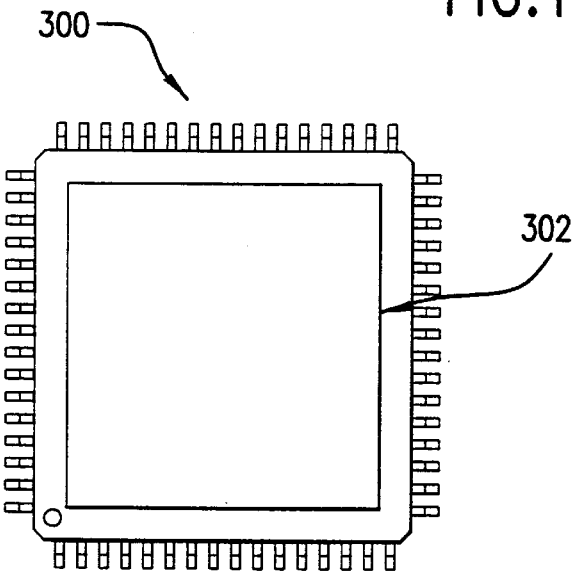
FIG. 3 is a top view of a 64-pin quad flat pack integrated circuit suitable for use as a pen driver circuit for a printer according to an exemplary preferred embodiment of the present invention.

Referring to FIG. 1, according to an exemplary preferred embodiment of the present invention, at least one signal of the interface 108 is omitted and the pen driver circuit 104 is configured to process a combination of signals including at least one of the signals remaining on the signal interface 108 to provide the at least one omitted signal. An exemplary preferred pen driver circuit 104 comprises a 64-pin quad flat pack integrated circuit 300 (FIG. 3) configured to process a combination of signals including at least one data transfer signal from the signal interface 108 to provide information associated with a signal line which has been eliminated from the signal interface 108. The exemplary preferred IC 300 includes a thermal pad 302 to which an external heat sink (not shown) can be attached if needed. It should be understood that the scope of the present invention is not limited to a pen driver circuit 104 which comprises a 64-pin quad flat pack integrated circuit. Other types of circuits with the same or different numbers of pins are also suitable for implementing the pen driver circuit 104.

According to an exemplary preferred embodiment of the present invention, both the digital controller 102 and the pen driver IC 104 are on a circuit card within a printer, for example, an InkJet printer. Alternatively, each IC can be on separate boards within the printer. Also, if the printer only includes the pen driver IC 104, the controller circuit 102 can be positioned on partner electronics which are not a part of the printer.

Figure 4:
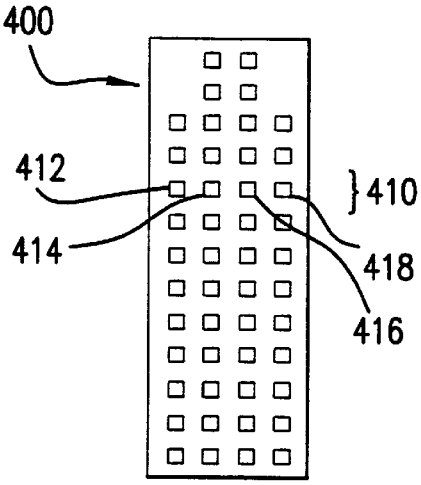
FIG. 4 is a front view of a printhead which is suitable for being controlled by an exemplary preferred signaling scheme of the present invention.

FIG. 4 shows a printhead 400 suitable for being controlled by the signaling scheme of the present invention. The printhead 400 is, for example, part of a print cartridge of a printer and includes a plurality of nozzle resistors configured into thirteen rows or "groups" as shown. Eleven of the groups have four nozzle resistors and two of the groups have two nozzle resistors. By way of example, a nozzle resistor group 410 includes nozzle resistors 412, 414, 416 and 418. Thus, in the illustrated exemplary printhead 400, the total number of resistors is 11×4+2×2=48. When one of the thirteen nozzle resistor groups is selected, any combination of the four (or two) resistors in that group may be fired. Consequently, up to four resistors may be fired simultaneously since only one group is (typically) selected at a time. It should be understood that the signaling scheme of the present invention is equally applicable to different types of printheads as well as to printheads with different numbers, arrangements and/or groupings of nozzle resistors.

Figure 5:
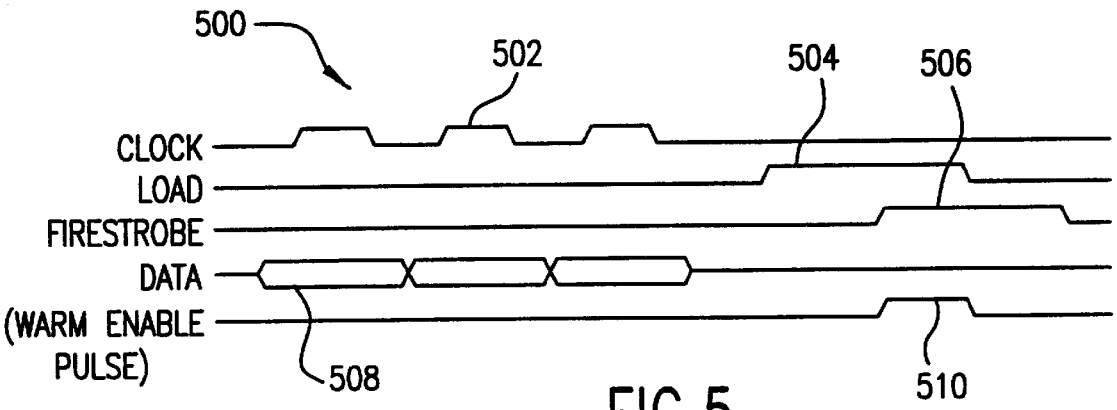
FIG. 5 shows waveforms for an exemplary preferred 4-signal serial interface for a controller circuit and a pen driver circuit for a printer according to the present invention.

FIG. 5 shows a signal timing diagram 500 for an exemplary preferred 4-signal serial interface according to the present invention. Like the serial interface 108 (FIG. 1), the 4-signal serial interface provides a control and communications link between a controller circuit and a pen driver circuit for a printer. However, in the exemplary preferred 4-signal serial interface, the WARMSTROBE signal 210 (FIG. 2) has been eliminated from the interface.

Figure 2:
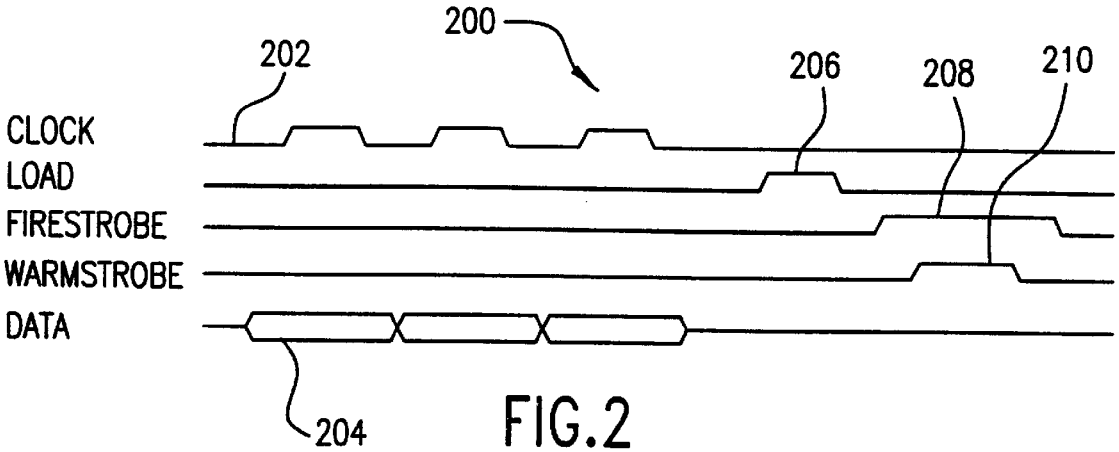
FIG. 2 shows waveforms for the conventional serial interface of FIG. 1.

Referring to FIG. 5, the timing diagram 500 shows CLOCK 502, LOAD 504, FIRESTROBE 506 and DATA 508 signals which are provided to the pen driver IC through the 4-signal serial interface. FIG. 5 also shows a "warm enable pulse" 510 which is generated internally by a pen driver circuit. Thus, the 4-signal serial interface still supports pen warming even though it does not include a line for the WARMSTROBE signal 210 (FIG. 2).

If warming is required, the LOAD pulse 504 is extended to overlap the FIRESTROBE signal 506, and the pen driver IC warms the pen for the duration of the overlap. All nozzle resistors are driven through the overlap interval (indicated by the "warm enable pulse" 510 waveform). When the LOAD signal 504 returns low, the warmed nozzle resistors are turned off, and only the resistors to be fired remain on until the FIRESTROBE signal 506 returns low. If only warming is required without any printing, the FIRESTROBE signal 506 is returned low in unison with the LOAD signal 504. If only printing is required without pulse warming, the LOAD signal 504 is returned low before the FIRESTROBE signal 506 goes high to avoid any overlap time. The DATA signal 508 is shown only for completeness and is not used in the pulse warming combination function for this specific example. However, a similar scheme could be implemented using the DATA signal 508 for the combination function after the data transfer is completed provided it does not already have some other function at that time (such as a reverse-direction data path, for instance).

Figure 6:
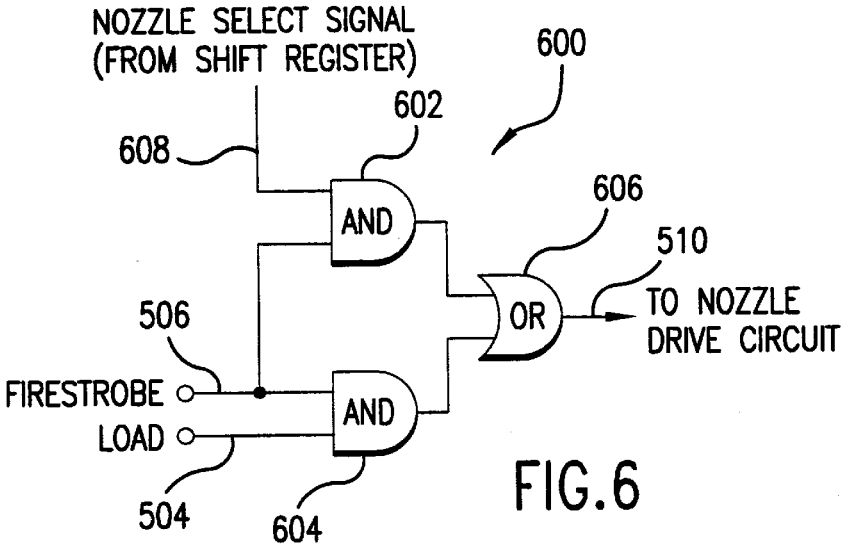
FIG. 6 shows an exemplary preferred combinatorial logic configuration for implementing the 4-signal serial interface of FIG. 5 in a pen driver circuit for a printer.

The "warm enable pulse" 510 shown in FIG. 5 is functionally identical to the external dedicated WARMSTROBE signal 210 (FIG. 2) and requires only a small amount of combinatorial logic to generate. FIG. 6 shows an exemplary preferred combinatorial logic circuit 600 for implementing the 4-signal serial interface in a pen driver circuit for a printer. A circuit such as the logic circuit 600 is provided for each nozzle and includes AND-gates 602 and 604 and an OR-gate 606 configured as shown. The nozzle is driven whenever the output of the OR-gate 606 is true (high), which happens when either of two conditions is met: both FIRESTROBE 506 and LOAD 504 are true, or the given nozzle is selected with a nozzle select signal 608 (via the serial bits shifted into a shift register, for instance) and FIRESTROBE 506 is asserted. Other circuits providing the same logic behavior as that of the logic circuit 600 (using negative logic, for example) are also contemplated as being within the scope of the present invention.

Figure 7:
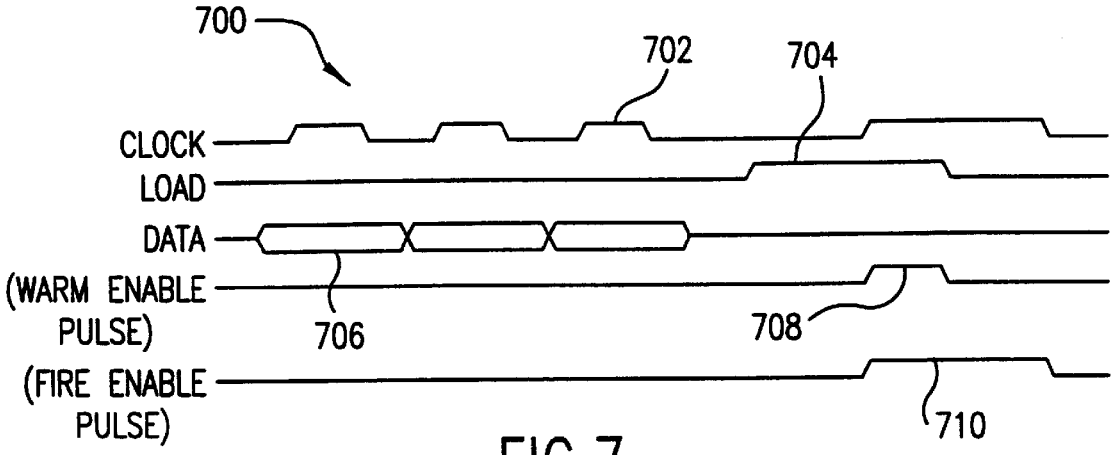
FIG. 7 shows waveforms for an exemplary preferred 3-signal serial interface for a controller circuit and a pen driver circuit for a printer according to the present invention.

FIG. 7 shows a signal timing diagram 700 for an exemplary preferred 3-signal serial interface according to the present invention. Like the serial interface 108 (FIG. 1), the 3-signal serial interface provides a control and communications link between a controller circuit and a pen driver circuit for a printer. However, in the exemplary preferred 3-signal serial interface, the FIRESTROBE signal 208 and the WARMSTROBE signal 210 (FIG. 2) have been eliminated from the interface.

Referring to FIG. 7, the timing diagram 700 shows CLOCK 702, LOAD 704 and DATA 706 signals which are provided to the pen driver IC through the 3-signal serial interface. FIG. 7 also shows a "warm enable pulse" 708 and a "fire enable pulse" 710 which are generated internally by a pen driver circuit. Thus, the 3-signal serial interface still supports pen firing and warming even though it does not include lines for. the FIRESTROBE signal 208 and the WARMSTROBE signal 210 (FIG. 2).

Figure 8:
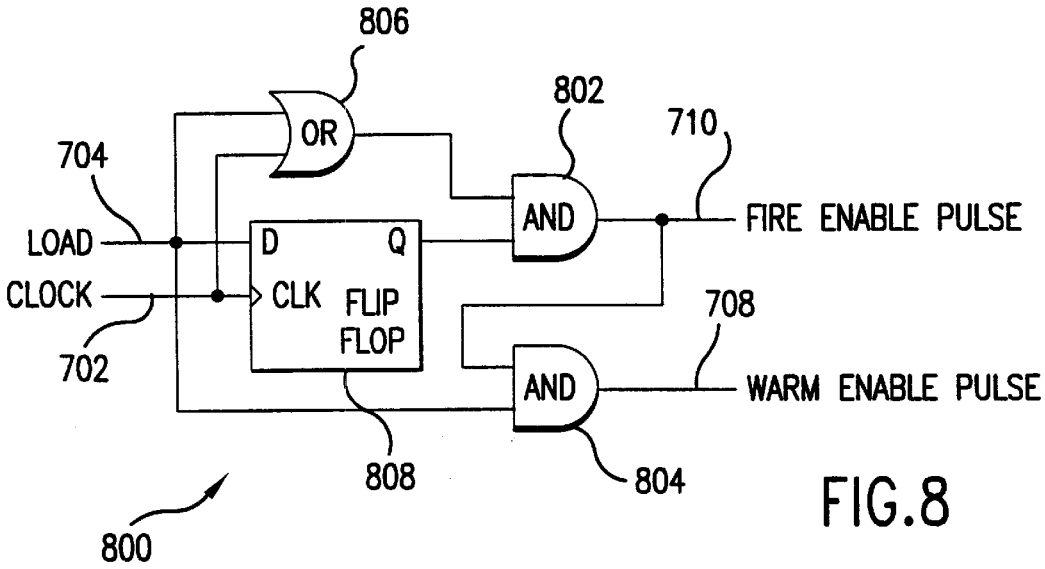
FIG. 8 shows an exemplary preferred combinatorial logic configuration for implementing the 3-signal serial interface of FIG. 7 in a pen driver circuit for a printer.
Figure 9:
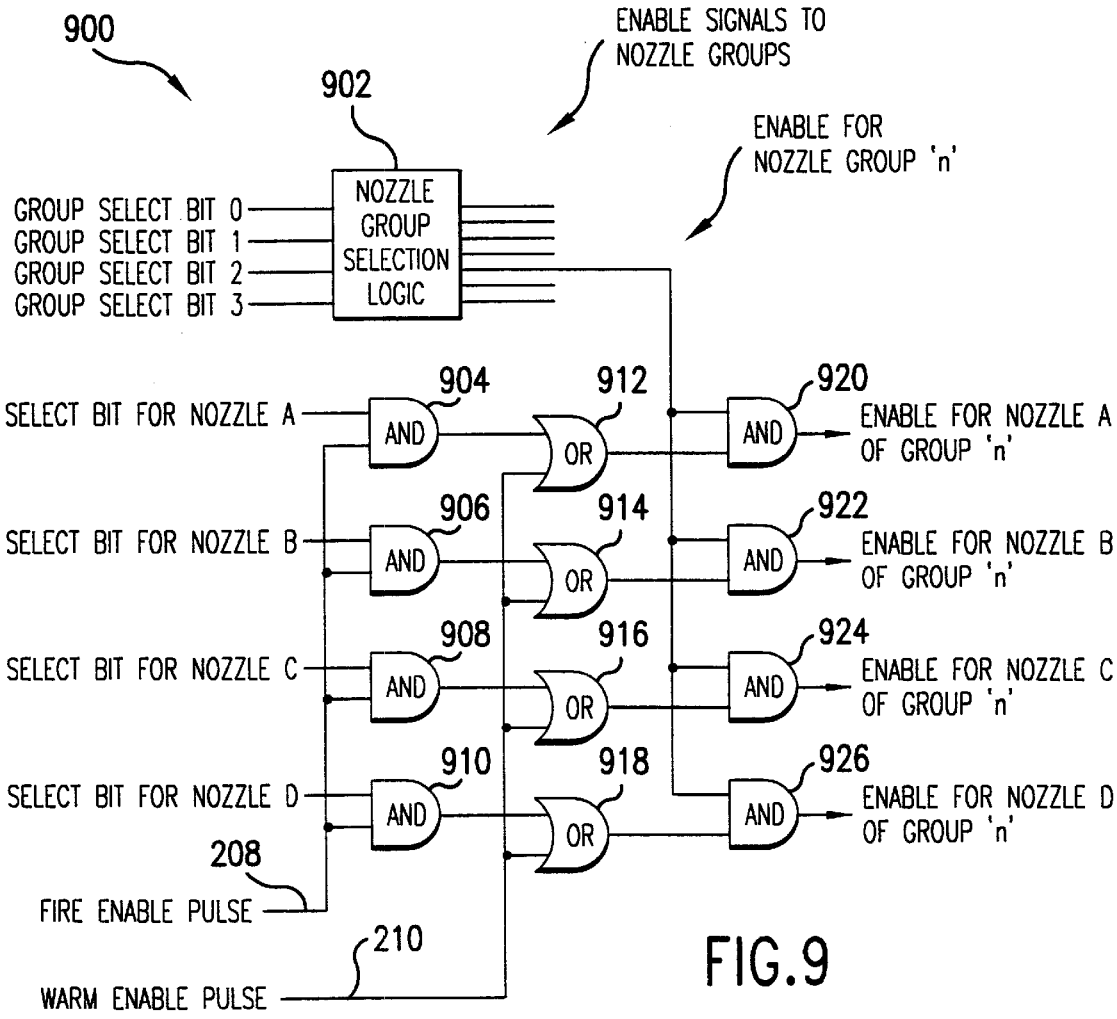
FIG. 9 is a schematic of a conventional multiplexing scheme for controlling nozzles in a printhead of a printer.

The "warm enable pulse" 708 and the "fire enable pulse" 710 shown in FIG. 7 are functionally identical to the external dedicated WARMSTROBE signal 210 and FIRESTROBE signal 208 (FIG. 2), respectively, and require only a small amount of combinatorial logic to generate. FIG. 8 shows an exemplary preferred combinatorial logic circuit 800 for implementing the 3-signal serial interface in a pen driver circuit for a printer. A circuit such as the logic circuit 800 is provided for each nozzle and includes AND-gates 802 and 804, an OR-gate 806 and a "D" flip-flop 808 configured as shown. Additional AND-gates at the output of AND-gates 802 and 804 for a nozzle select signal as discussed supra are not shown.

The "fire enable pulse" 710 is generated on the rising edge of the CLOCK signal 702 when the LOAD signal 704 is high. The "warm enable pulse" 708 is generated the same way as in the previous embodiment, but now the "fire enable pulse" 710 is ANDed with the LOAD signal 704 to create the internal signal. The circuit 800 is enabled when the output of the flip-flop 808 output goes high, which will occur only after the data transfer has finished (LOAD 704 is driven high, then CLOCK 702 is driven high). After the CLOCK signal 702 goes low, the "fire enable pulse" 710 returns low. On the next data transfer, the low value of the LOAD signal 704 is clocked into the flip-flop 808, thus resetting the circuit 800 for the next firing/warming interval. Firing without warming is triggered by dropping the LOAD signal 704 at the same time the CLOCK signal 702 goes high. Warming without firing is implemented by returning the CLOCK signal 702 and the LOAD signal 704 to low simultaneously.

In this example, warming occurs during the first portion of the firing cycle. An alternate approach is to make the "warm enable pulse" 708 equal to the "fire enable pulse" 710 ANDed with the inverted value of the LOAD signal 704.

This would cause warming to occur during the latter portion of the firing cycle and may help alleviate some potential logic timing issues due to a race condition between the CLOCK signal 702 and the LOAD signal 704.

Other circuits providing the same logic behavior as that of the logic circuit 800 are also contemplated as being within the scope of the present invention. For example, the DATA signal 706 could be used for controlling firing or warming while the LOAD signal 704 is high—provided that it is not being driven in a reverse direction by the pen driver IC (if the DATA signal 706 is a bi-directional signal).

Each signal adds to the size and cost of cables and connectors and may require filter components to pass regulatory or signal integrity requirements. By keeping the signal count and driver IC complexity to a minimum, a balance is achieved keeping the system cost low. The ideal number of signals from a cost standpoint will vary from system to system.

Although the present inventions have been described in terms of the preferred embodiment above, numerous modifications and/or additions to the above-described preferred embodiment would be readily apparent to one skilled in the art. It is intended that the scope of the present inventions extend to all such modifications and/or additions.

I claim:

1. A signaling system for a pen driver interface, comprising:

means for eliminating a warm enable pulse signal from an interface between a controller and a pen driver circuit; and means for employing the pen driver circuit to derive the warm enable pulse signal from a combination of signals remaining on the interface.

2. A signaling system according to claim 1, wherein the pen firing control signal is a warm enable pulse signal.

3. A signaling system according to claim 1, wherein the pen firing control signal is a fire enable pulse signal.

4. A signaling system according to claim 1, wherein the combination of signals includes a load signal.

5. A signaling system according to claim 1, wherein the combination of signals includes a firestrobe signal.

6. A signaling system according to claim 1, wherein the combination of signals includes a clock signal.

7. A signaling system according to claim 1, wherein the combination of signals includes a data signal.

8. A signaling system for a pen driver interface, comprising:

means for reducing a number of signal lines for a signal interface between a controller circuit and a pen driver circuit for a printer; and when data is not being transferred via the signal interface, means for employing the pen driver circuit to process a combination of signals including at least one data transfer signal from the signal interface to provide information associated with a signal line which has been eliminated form the signal interface.

9. A signaling system according to claim 8, wherein the information comprises firing pulse information.

10. A signaling system according to claim 8, wherein the information comprises warming pulse information.

11. A signaling system for a pen driver interface, comprising:

means for providing a signal interface between a controller circuit and a pen driver circuit for a printer;

means for extending the duration of a data transfer signal of the signal interface; and means for configuring the pen driver circuit to process a combination of signals from the signal interface including the data transfer signal to provide a pen firing control signal.

12. A signaling system according to claim 11, wherein the data transfer signal is a load signal.

13. A signaling system according to claim 11, wherein the combination of signals includes a firestrobe signal.

14. A signaling system according to claim 11, wherein the combination of signals includes a clock signal.

15. A signaling system according to claim 11, wherein the combination of signals includes a data signal.

16. A signaling system according to claim 11, wherein the pen firing control signal is a fire enable signal.

17. A signaling system according to claim 11, wherein the pen firing control signal is a warm enable pulse.

* * * * *